US007666245B2

(12) United States Patent
Imori et al.

(10) Patent No.: US 7,666,245 B2
(45) Date of Patent: Feb. 23, 2010

(54) METALLIC POWDER FOR POWDER METALLURGY WHOSE MAIN COMPONENT IS IRON AND IRON-BASED SINTERED BODY

(75) Inventors: Toru Imori, Ibaraki (JP); Atsushi Nakamura, Ibaraki (JP); Yasushi Narusawa, Ibaraki (JP); Masataka Yahagi, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 313 days.

(21) Appl. No.: 11/574,294

(22) PCT Filed: Aug. 5, 2005

(86) PCT No.: PCT/JP2005/014433

§ 371 (c)(1),
(2), (4) Date: Feb. 26, 2007

(87) PCT Pub. No.: WO2006/025188

PCT Pub. Date: Mar. 9, 2006

(65) Prior Publication Data

US 2007/0231180 A1 Oct. 4, 2007

(30) Foreign Application Priority Data

Aug. 30, 2004 (JP) ..... 2004-249758

(51) Int. Cl.
*B22F 3/10* (2006.01)
*B22F 1/00* (2006.01)

(52) U.S. Cl. ..... 75/246; 75/252; 417/37

(58) Field of Classification Search ..... 75/252, 75/246; 419/37

See application file for complete search history.

(56) References Cited

U.S. PATENT DOCUMENTS

| | | | |
|---|---|---|---|
| 2,001,134 | A | 5/1935 | Hardy |
| 2,307,343 | A | 1/1943 | Whipple |
| 2,354,218 | A | 7/1944 | Murray |
| 2,593,943 | A | 4/1952 | Wainer |
| 2,799,080 | A | 7/1957 | Duckworth |
| 3,660,288 | A | 5/1972 | Hansen |
| 4,834,800 | A | 5/1989 | Semel |
| 5,308,702 | A | 5/1994 | Furukimi et al. |
| 5,415,791 | A | 5/1995 | Chou et al. |
| 5,980,819 | A | 11/1999 | Nakagawa et al. |
| 6,013,723 | A | 1/2000 | Akao |
| 6,132,487 | A | 10/2000 | Mori |
| 6,261,336 | B1 | 7/2001 | Behi et al. |
| 7,217,310 | B2 | 5/2007 | Yahagi et al. |
| 7,347,969 | B2 | 3/2008 | Yahagi et al. |
| 2005/0166709 | A1 | 8/2005 | Yahagi et al. |
| 2005/0271540 | A1 | 12/2005 | Yahagi et al. |
| 2007/0292298 | A1 | 12/2007 | Imori et al. |
| 2008/0138642 | A1 | 6/2008 | Yahagi et al. |

FOREIGN PATENT DOCUMENTS

| | | | |
|---|---|---|---|
| JP | 04-176801 | A | 6/1992 |
| JP | 04-191301 | A | 7/1992 |
| JP | 06-290919 | A | 10/1994 |
| JP | 10-046201 | A | 2/1998 |
| JP | 2003-003201 | A | 1/2003 |

OTHER PUBLICATIONS

ESP@CENET Database, English Abstract of JP 61-034101, Feb. 18, 1986.

*Primary Examiner*—Roy King
*Assistant Examiner*—Ngoclan T Mai
(74) *Attorney, Agent, or Firm*—Howson & Howson LLP

(57) ABSTRACT

Provided is iron-based metal powder for powder metallurgy including a metallic soap containing at least one or more types of metal selected from a group of Ag, Au, Bi, Co, Cu, Mo, Ni, Pd, Pt, Sn and Te having a higher standard oxidization potential than iron, and an additional metal which forms a liquid phase at a temperature of 1200° C. or less in the combination with the metal, wherein the soap contains metal for forming an alloy phase between the two. As a result, obtained is mixed powder for powder metallurgy capable of improving the rust prevention effect easily without having to hardly change the conventional processes.

6 Claims, No Drawings

METALLIC POWDER FOR POWDER METALLURGY WHOSE MAIN COMPONENT IS IRON AND IRON-BASED SINTERED BODY

BACKGROUND OF THE INVENTION

The present invention generally relates to mixed powder for powder metallurgy to be used in the manufacture of sintered parts, brushes and so on, and particularly relates to iron-based powder for powder metallurgy suitable for the manufacture of iron sintered parts superior in rust prevention performance to be used as solid lubricants and the like, as well as to an iron sintered body.

Generally speaking, iron powder used for the purposes of sintered machine parts, sintered oil retaining bearings, metal graphite brushes and so on rusts easily, and is generally used by mixing an organic rust preventive agent such as benzotriazole therein.

Nevertheless, although such an organic rust preventive agent has a temporary rust prevention effect, since it dissolves or becomes vaporized at a temperature of 500° C. or higher, it will disappear at an ordinarily used sintering temperature of 700° C. or higher. Therefore, after sintering, this will become the same state as when no rust prevention measures are taken, and there is a problem in that the iron powder will rust extremely easily.

Meanwhile, in order to obtain rust prevention properties after sintering, proposals have been made for obtaining a composite powder sintered body by mixing minute amounts of metal powder such as zinc, bismuth or lead with the iron-based sintering powder, or mixing the vapor thereof to the gas upon sintering.

Nevertheless, since this will increase new processes, there is a problem in that the manufacturing process will become complex and, as a result, there will be variations in the quality.

As a conventional powder metallurgical additive, there is an additive having organic acid cobalt metal soap as its component, and technology is disclosed for manufacturing a sintered body by adding and mixing this at 0.1 to 2.0% by weight, and molding and sintering this mixed powder (e.g., refer to Japanese Patent Laid-Open Publication No. H10-46201).

Further, disclosed is technology of adding and mixing metal stearate to, and thereafter dry-pulverizing, a rare earth-iron-boron permanent magnet alloy coarse powder mainly composed in atomic % of rare earth element R (among rare-earth elements containing Y, one or two or more elements are combined) of 10 to 25%, boron B of 1 to 12%, and the remaining part consisting of iron Fe, wherein a part of Fe is replaced at least with one or more kinds of elements selected from Co, Ni, Al, Nb, Ti, W, Mo, V, Ga, Zn and Si in a range of 0 to 15%, if necessary (e.g., refer to Japanese Patent Laid-Open Publication No. H6-290919).

Further, disclosed is a molding improving agent which consists of alloy powder for permanent magnets obtained by compounding at least 1 type of stearate to at least one type selected from polyoxyethylene alkyl ether, polyoxyethylene monofatty acid ester and polyoxyethylene alkylallylether at a compound ratio of 1/20 to 5/1 (e.g., refer to Japanese Patent Laid-Open Publication No. S61-34101).

SUMMARY OF THE INVENTION

An object of the present invention is to obtain iron-based powder for powder metallurgy capable of improving the rust prevention effects easily without having to hardly change the conventional processes, and an iron sintered body having a rust prevention function obtained by sintering such iron-based powder for powder metallurgy.

As a result of intense study to overcome the foregoing problems, the present inventors discovered that, by mixing a specific additive upon molding iron-based sintering powder, an effect is yielded as a molding lubricant, metal components can be dispersed evenly, and rust prevention effects can be significantly improved in the parts even after sintering.

Based on the foregoing discovery, the present invention provides: 1) iron-based metal powder for powder metallurgy including a metallic soap containing at least one or more types of metal selected from a group of Ag, Au, Bi, Co, Cu, Mo, Ni, Pd, Pt, Sn and Te having a higher standard oxidization potential than iron, and an additional metal which forms a liquid phase at a temperature of 1200° C. or less in the combination with the metal, wherein the soap contains metal for forming an alloy phase between the two; and 2) an iron-based sintered body having a rust prevention function, including a metallic soap containing at least one or more types of metal selected from a group of Ag, Au, Bi, Co, Cu, Mo, Ni, Pd, Pt, Sn and Te having a higher standard oxidization potential than iron, and an additional metal which forms a liquid phase at a temperature of 1200° C. or less in the combination with the metal, wherein an alloy phase constituted from both metals is formed on the sintered body surface upon sintering.

As described above, as a result of obtaining mixed powder for powder metallurgy by adding the metallic soap of the present invention to iron-based metal powder for powder metallurgy, the rust prevention effect of sintered bodies such as sintered machine parts, sintered oil retaining bearings and metal graphite brushes can be exponentially improved without changing the conventional sintered body manufacturing process.

DETAILED DESCRIPTION OF THE INVENTION

In devising the present invention, the present inventors took particular note of minute amounts of zinc stearate to be added as a lubricant upon molding powder. Nevertheless, since this zinc stearate dissipates during sintering and has high corrosiveness, there is a problem in that it will damage the sintering furnace, and the rust prevention effect is no different than a case without any additives.

As described above, since this zinc stearate is mainly used as a lubricant during molding, the present inventors sought for a material having the same lubricant function as zinc stearate and also capable of improving the rust prevention effect not found in zinc stearate.

As a result, obtained was a method of adding a metallic soap having a higher standard oxidization potential (standard oxidization potential of $Fe/Fe^{2+}$ is −0.440V), which possesses a function as a molding lubricant equal to zinc stearate and is capable of improving the rust prevention effect even after sintering, to powder for powder metallurgy. Thereby, the rust prevention effect of a sintered body can be exponentially improved without having to change the conventional sintered body manufacturing process.

As the metal having a higher standard oxidation potential than iron, one or more types of metal selected from a group of Ag, Au, Bi, Co, Cu, Mo, Ni, Pd, Pt, Sn and Te is used. Pb and Cd are not used since these cause problems of environmental pollution.

Further, in the combination with the foregoing metal, the soap of the present invention is characterized in containing an additional metal which forms a liquid phase at a temperature of 1200° C. or less, and wherein the soap contains metal for forming an alloy phase between the two. All metals having a melting point of 1200° C. or less, and which are capable of forming a solid solution phase on the metal side may be employed as a metal which forms a liquid phase at 1200° C. or less.

For instance, Zn, Al, Sb, Yb, In, K, Ga, Ca, Au, Ag, Ge, Sm, Sn, Ce, Te, Cu, Na, Nb, Ba, Bi, Pr, Mg, Eu, La, Li and P may be considered. Among the above, In, Sn and Bi with rust prevention effects are particularly favorable metals.

These soaps take on a liquid phase at a sintering temperature of 1100 to 1200° C., and form an alloy phase by being dispersed and concentrated on the sintered body surface with appropriate vapor pressure. And it has been discovered that these yield extremely superior rust prevention effects.

Further, the metallic soaps such as metallic soap stearate, metallic soap propionate, metallic soap naphthenate and so on may be used as soaps.

It is desirable that these metallic soaps are generally added at 0.1 to 2.0 parts by weight to iron-based metal powder for powder metallurgy 100 parts by weight.

Nevertheless, this additive amount may be changed according to the type of sintered body, and does not necessarily have to be limited to the foregoing additive amount. In other words, the additive amount may be arbitrarily set within a scope that is capable of maintaining the characteristics of the target sintered body.

Further, the powder for powder metallurgy to be added to these metallic soaps is not necessarily limited to iron powder, and other powder where iron is coated on the metal powder or powder mixed with iron may also be employed for improving the rust prevention effect.

EXAMPLES

Next, the Examples are explained. Further, these Examples are merely illustrative, and the present invention shall in no way be limited thereby. In other words, the present invention shall include all other modes or modifications other than these Examples within the scope of the technical spirit of this invention.

Example 1

Synthesized cobalt stearate (Co content 12.0% by weight) was pulverized minutely and passed through a sieve in order to obtain fine powder of 250 mesh or less. Similarly, the fine powders of indium stearate (In content 12.0% by weight) and tin stearate (Sn content 12.0% by weight) were also obtained, respectively.

Cu 3 wt %, graphite powder 1 wt %, and the foregoing cobalt stearate (abbreviated as "St.Co" in Table 1) 0.11 wt % and indium stearate (St.In) 0.69 wt % (both not included in the total number) or cobalt stearate (St.Co) 0.54 wt % and tin stearate (St.Sn) 0.26 wt % (both not included in the total number) were mixed with iron powder (Hoganas reduced iron powder) 96 wt % in order to prepare three types of mixed powder each (samples No. 1 to 6).

This mixed powder (fill of 2.5 g) was molded into a specimen of approximately 10.02 mm ϕ×4.51 to 4.61 mmt at a molding pressure of 6 t/cm$^2$.

In order to judge the moldability, details regarding the relationship of the green density (GD) and molding pressure of each compact are shown in Table 1 (samples No. 1 to 6).

The moldability of mixed powder was evaluated regarding these specimens, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 1. As a result of sintering, the alloy phase of $CoIn_2$, $CoIn_3$, CoSn and $CoSn_2$ having a low melting point was formed on the surface.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 1

| | | | | | Before Sintering | | | | After Sintering at 1150° C., 1 hr, under $H^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 1 | St.Co + St.In | 2.5 | 6 | 420 | 10.02 | 4.52 | 2.50 | 7.02 | 10.02 | 4.53 | 2.46 | 6.89 |
| 2 | | 2.5 | 6 | 420 | 10.02 | 4.53 | 2.51 | 7.03 | 10.02 | 4.54 | 2.47 | 6.90 |
| 3 | | 2.5 | 6 | 420 | 10.02 | 4.51 | 2.50 | 7.03 | 10.02 | 4.51 | 2.46 | 6.92 |
| 4 | St.Co + St.Sn | 2.5 | 6 | 420 | 10.02 | 4.53 | 2.49 | 6.97 | 10.03 | 4.52 | 2.46 | 6.89 |
| 5 | | 2.5 | 6 | 420 | 10.02 | 4.61 | 2.53 | 6.96 | 10.03 | 4.60 | 2.50 | 6.88 |
| 6 | | 2.5 | 6 | 420 | 10.02 | 4.61 | 2.53 | 6.96 | 10.02 | 4.60 | 2.50 | 6.90 |

TABLE 2

| | | Oxidation Resistance | | |
|---|---|---|---|---|
| | Additive | After 96 hours | After 168 hours | After 336 hours |
| Example 1 | Co Stearate + In or Sn | * No Discoloration | Slight Discoloration | Slight Discoloration |
| Example 2 | Mo Stearate + Sn | * No Discoloration | Slight Discoloration | Slight Discoloration |
| Example 3 | Ni Stearate + Bi, In or Sn | * No Discoloration | Slight Discoloration | Slight Discoloration |
| Example 4 | Pd Stearate + Bi, In or Sn | * No Discoloration | Slight Discoloration | Slight Discoloration |

TABLE 2-continued

| | Additive | Oxidation Resistance | | |
|---|---|---|---|---|
| | | After 96 hours | After 168 hours | After 336 hours |
| Comparative Example 1 | Zn Stearate | A Little Discoloration | x Severe Discoloration | x Severe Discoloration |
| Comparative Example 2 | Sr Stearate | x Severe Discoloration | x Severe Discoloration | x Severe Discoloration |
| Comparative Example 3 | Ba Stearate | A Little Discoloration | x Severe Discoloration | x Severe Discoloration |
| Comparative Example 4 | Re Stearate | x Severe Discoloration | x Severe Discoloration | x Severe Discoloration |
| Comparative Example 5 | Additive Free | A Little Discoloration | x Severe Discoloration | x Severe Discoloration |

Example 2

Synthesized molybdenum stearate (Mo content 12.0% by weight) was pulverized minutely and passed through a sieve in order to obtain fine powder of 250 mesh or less. Similarly, the fine powder of tin stearate (Sn content 12.0% by weight) was also obtained.

Cu 3 wt %, graphite powder 1.0 wt %, and the foregoing molybdenum stearate (abbreviated as "St.Mo" in Table 3) 0.24 wt % (not included in the total number) and tin stearate (St.Sn) 0.56 wt % (not included in the total number) were mixed with iron powder (Hoganas reduced iron powder) 96 wt % in order to prepare six types of samples (samples No. 11 to 16).

This mixed powder (fill of 2.5 g) was molded into a specimen of approximately 10.02 to 10.04 mm ϕ×4.52 to 4.56 mmt at a molding pressure of 6 t/cm$^2$.

In order to judge the moldability, details regarding the relationship of the green density (GD) and molding pressure of each compact are shown in Table 3 (samples No. 11 to 16).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 3. As a result of sintering, the alloy phase of $MoSn_2$ having a low melting point was formed on the surface.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

Example 3

Synthesized nickel stearate (Ni content 12.0% by weight) was pulverized minutely and passed through a sieve in order to obtain fine powder of 250 mesh or less. Similarly, the fine powders of indium stearate (In content 12.0% by weight), tin stearate (Sn content 12.0% by weight) and bismuth stearate (Bi content 12.0% by weight) were also obtained, respectively.

Cu 3 wt %, graphite powder 1.0 wt %, and the foregoing nickel stearate (abbreviated as "St.Ni" in Table 4) 0.27 wt % (not included in the total number) and indium stearate (St.In) 0.53 wt % (not included in the total number) or nickel stearate 0.22 wt % (not included in the total number) and tin stearate (St.Sn) 0.58 wt % (not included in the total number) or nickel stearate 0.07 wt % (not included in the total number) and bismuth stearate (St.Bi) 0.73 wt % (not included in the total number) were mixed with iron powder (Hoganas reduced iron powder) 96 wt % (samples No. 21 to 28).

This mixed powder (fill of 2.5 g) was molded into a specimen of approximately 10.02 to 10.04 mm ϕ×4.52 to 4.59 mmt at a molding pressure of 6 t/cm$^2$.

In order to judge the moldability, details regarding the relationship of the green density (GD) and molding pressure of each compact are shown in Table 4 (samples No. 21 to 28).

The moldability of mixed powder was evaluated regarding these specimens, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 4. As a result of sintering, the alloy phase of $Ni_3In$, $Ni_2In$, $Ni_{23}In_9$, NiIn, $Ni_2In_3$, $Ni_{28}In_{72}$, $Ni_3Sn_2$, $Ni_3Sn_4$, NiBi and $NiBi_3$ having a low melting point was formed on the surface.

TABLE 3

| No. | Soap | Fill g | Pressure t · cm$^{-2}$ | Pressure (Device) kgf · cm$^{-2}$ | Before Sintering ϕ mm | t mm | w g | GD g/cc | After Sintering at 1150° C., 1 hr, under $H^2$ ϕ mm | t mm | w g | SD g/cc |
|---|---|---|---|---|---|---|---|---|---|---|---|---|
| 11 | St.Mo + St.Sn | 2.5 | 6 | 420 | 10.03 | 4.54 | 2.50 | 6.97 | 10.03 | 4.50 | 2.47 | 6.95 |
| 12 | | 2.5 | 6 | 420 | 10.03 | 4.56 | 2.51 | 6.97 | 10.04 | 4.53 | 2.48 | 6.92 |
| 13 | | 2.5 | 6 | 420 | 10.02 | 4.53 | 2.50 | 7.00 | 10.04 | 4.50 | 2.47 | 6.94 |
| 14 | | 2.5 | 6 | 420 | 10.03 | 4.56 | 2.51 | 6.97 | 10.02 | 4.52 | 2.49 | 6.99 |
| 15 | | 2.5 | 6 | 420 | 10.04 | 4.53 | 2.49 | 6.95 | 10.02 | 4.50 | 2.47 | 6.96 |
| 16 | | 2.5 | 6 | 420 | 10.03 | 4.52 | 2.49 | 6.98 | 10.03 | 4.50 | 2.47 | 6.95 |

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

Incidentally, although the same process was performed with bismuth propionate and bismuth naphthenate under the same conditions in addition to bismuth stearate, similar results were obtained.

TABLE 4

| | | | | | Before Sintering | | | | After Sintering at 1150° C., 1 hr, under $H^2$ | | | |
|---|---|---|---|---|---|---|---|---|---|---|---|---|
| No. | Soap | Fill g | Pressure $t \cdot cm^{-2}$ | Pressure (Device) $kgf \cdot cm^{-2}$ | ϕ mm | t mm | w g | GD g/cc | ϕ mm | t mm | w g | SD g/cc |
| 21 | St.Ni + St.In | 1.5 | 6 | 420 | 10.02 | 2.73 | 1.52 | 7.06 | 10.03 | 2.75 | 1.50 | 6.91 |
| 22 | | 1.5 | 6 | 420 | 10.03 | 2.74 | 1.52 | 7.02 | 10.03 | 2.74 | 1.50 | 6.93 |
| 23 | | 2.5 | 6 | 420 | 10.03 | 4.59 | 2.50 | 6.90 | 10.03 | 4.57 | 2.46 | 6.82 |
| 24 | St.Ni + St.Sn | 2.5 | 6 | 420 | 10.03 | 4.54 | 2.51 | 7.00 | 10.03 | 4.56 | 2.48 | 6.89 |
| 25 | | 2.5 | 6 | 420 | 10.03 | 4.56 | 2.52 | 7.00 | 10.03 | 4.56 | 2.49 | 6.91 |
| 26 | St.Ni + St.Bi | 2.5 | 6 | 420 | 10.02 | 4.55 | 2.51 | 7.00 | 10.02 | 4.56 | 2.48 | 6.90 |
| 27 | | 2.5 | 6 | 420 | 10.02 | 4.52 | 2.50 | 7.02 | 10.03 | 4.52 | 2.46 | 6.89 |
| 28 | | 2.5 | 6 | 420 | 10.03 | 4.54 | 2.50 | 6.97 | 10.03 | 4.53 | 2.47 | 6.90 |

Example 4

Synthesized palladium stearate (Pd content 12.0% by weight) was pulverized minutely and passed through a sieve in order to obtain fine powder of 250 mesh or less.

Similarly, the fine powders of indium stearate (In content 12.0% by weight), tin stearate (Sn content 12.0% by weight) and bismuth stearate (Bi content 12.0% by weight) were also obtained, respectively.

Cu 3 wt %, graphite powder 1.0 wt %, and the foregoing palladium stearate (abbreviated as "St.Pd" in Table 5) 0.27 wt % (not included in the total number) and indium stearate (St.In) 0.53 wt % (not included in the total number) or palladium stearate 0.22 wt % (not included in the total number) and tin stearate (St.Sn) 0.58 wt % (not included in the total number) or palladium stearate 0.07 wt % (not included in the total number) and bismuth stearate (St.Bi) 0.73 wt % (not included in the total number) were mixed with iron powder (Hoganas reduced iron powder) 96 wt % (samples No. 31 to 38).

This mixed powder (fill of 1.5 to 2.5 g) was molded into a specimen of approximately 10.02 to 10.03 mm ϕ×2.73 to 4.59 mmH at a molding pressure of 6 t/cm$^2$.

In order to judge the moldability, details regarding the relationship of the green density (GD) and molding pressure of each compact are shown in Table 5 (samples No. 31 to 38).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 5.

As a result of sintering, the alloy phase of BiPd, $BiPd_3$, $Bi_2Pd$, $In_3Pd_2$, $In_3Pd$, PdSn, $PdSn_2$, $PdSn_3$ and $PdSn_4$ having a low melting point was formed on the surface.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 5

| | | | | | Before Sintering | | | | After Sintering at 1150° C., 1 hr, under $H^2$ | | | |
|---|---|---|---|---|---|---|---|---|---|---|---|---|
| No. | Soap | Fill g | Pressure $t \cdot cm^{-2}$ | Pressure (Device) $kgf \cdot cm^{-2}$ | ϕ mm | t mm | w g | GD g/cc | ϕ mm | t mm | w g | SD g/cc |
| 31 | St.Pd + St.In | 1.5 | 6 | 420 | 10.02 | 2.73 | 1.50 | 6.97 | 10.02 | 2.73 | 1.49 | 6.92 |
| 32 | | 1.5 | 6 | 420 | 10.03 | 2.73 | 1.49 | 6.91 | 10.02 | 2.73 | 1.48 | 6.88 |
| 33 | | 2.5 | 6 | 420 | 10.03 | 4.57 | 2.51 | 6.95 | 10.03 | 4.57 | 2.48 | 6.87 |
| 34 | St.Pd + St.Sn | 2.5 | 6 | 420 | 10.03 | 4.59 | 2.53 | 6.98 | 10.03 | 4.57 | 2.50 | 6.93 |
| 35 | | 2.5 | 6 | 420 | 10.02 | 4.58 | 2.52 | 6.98 | 10.03 | 4.58 | 2.50 | 6.91 |
| 36 | | 2.5 | 6 | 420 | 10.03 | 4.57 | 2.50 | 6.93 | 10.03 | 4.54 | 2.48 | 6.92 |
| 37 | St.Pd + St.Bi | 2.5 | 6 | 420 | 10.03 | 4.59 | 2.53 | 6.98 | 10.02 | 4.58 | 2.50 | 6.93 |
| 38 | | 2.5 | 6 | 420 | 10.03 | 4.57 | 2.53 | 7.01 | 10.02 | 4.57 | 2.51 | 6.97 |

Comparative Example 1

Zinc stearate SZ-2000 (manufactured by Sakai Chemical Industry) was used, and, as with Example 1, Cu 3 wt %, graphite powder 1.0 wt %, and the foregoing zinc stearate (abbreviated as "St.Zn" in Table 6) 0.8 wt % (not included in the total number) were mixed with iron powder 96 wt %. This mixed powder (fill of 1.5 to 2.5 g) was molded into a specimen of approximately 10.02 to 10.03 mm ϕ×2.75 to 4.62 mmH at a molding pressure of 6 t/cm$^2$.

In order to judge the moldability, the moldability of mixed powder was evaluated regarding these specimens under the same conditions as Example 1. Details regarding the relationship of the green density (GD) and molding pressure of each compact are shown in Table 6 (samples No. 41 to 48).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 6.

This sintered body was set inside a temperature and humidity controlled bath, and subject to a humidity oxidation test by performing an atmospheric exposure test in an atmosphere at a temperature of 4° C. and humidity of 95% for 336 hours. The humidity oxidation test results are shown in Table 2.

TABLE 6

| | | | | | Before Sintering | | | | After Sintering at 1150° C., 1 hr, under H$^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 41 | St.Zn | 1.5 | 6 | 420 | 10.02 | 2.75 | 1.51 | 6.97 | 10.03 | 2.75 | 1.50 | 6.91 |
| 42 | | 1.5 | 6 | 420 | 10.03 | 2.76 | 1.53 | 7.02 | 10.03 | 2.79 | 1.51 | 6.85 |
| 43 | | 2.5 | 6 | 420 | 10.03 | 4.60 | 2.54 | 6.99 | 10.02 | 4.58 | 2.51 | 6.95 |
| 44 | | 2.5 | 6 | 420 | 10.03 | 4.57 | 2.53 | 7.01 | 10.03 | 4.56 | 2.49 | 6.91 |
| 45 | | 2.5 | 6 | 420 | 10.02 | 4.58 | 2.52 | 6.98 | 10.02 | 4.55 | 2.49 | 6.94 |
| 46 | | 2.5 | 6 | 420 | 10.03 | 4.62 | 2.55 | 6.99 | 10.03 | 4.60 | 2.52 | 6.94 |
| 47 | | 2.5 | 6 | 420 | 10.03 | 4.56 | 2.51 | 6.97 | 10.03 | 4.53 | 2.48 | 6.93 |
| 48 | | 2.5 | 6 | 420 | 10.03 | 4.57 | 2.52 | 6.98 | 10.03 | 4.56 | 2.49 | 6.91 |

Comparative Example 2

Synthesized strontium stearate (Sr content 12.0% by weight) was pulverized minutely and passed through a sieve in order to obtain fine powder of 250 mesh or less. This strontium stearate (St.Sr) was used, and, as with Example 1, graphite powder 1.0 wt % and the foregoing strontium stearate (abbreviated as "St.Sr" in Table 7) 0.8 wt % (not included in the total number) were mixed with iron powder 99 wt %.

This mixed powder (fill of 1.5 to 2.5 g) was molded into a specimen of approximately 10.02 to 10.03 mm ϕ×2.75 to 4.57 mmH at a molding pressure of 6 t/cm$^2$.

In order to judge the moldability, the moldability of mixed powder was evaluated regarding these specimens under the same conditions as Example 1. Details regarding the relationship of the green density (GD) and molding pressure of each compact are shown in Table 7 (samples No. 51 to 57).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 7.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 7

| | | | | | Before Sintering | | | | After Sintering at 1150° C., 1 hr, under H$^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 51 | St.Sr | 1.5 | 6 | 420 | 10.03 | 2.75 | 1.52 | 7.00 | 10.03 | 2.75 | 1.50 | 6.91 |
| 52 | | 1.5 | 6 | 420 | 10.02 | 2.76 | 1.51 | 6.94 | 10.03 | 2.77 | 1.49 | 6.81 |
| 53 | | 2.5 | 6 | 420 | 10.03 | 4.57 | 2.52 | 6.98 | 10.04 | 4.56 | 2.49 | 6.90 |
| 54 | | 2.5 | 6 | 420 | 10.03 | 4.55 | 2.51 | 6.99 | 10.03 | 4.55 | 2.47 | 6.87 |
| 55 | | 2.5 | 6 | 420 | 10.02 | 4.57 | 2.51 | 6.97 | 10.03 | 4.56 | 2.48 | 6.89 |
| 56 | | 2.5 | 6 | 420 | 10.02 | 4.54 | 2.50 | 6.99 | 10.03 | 4.53 | 2.46 | 6.88 |
| 57 | | 2.5 | 6 | 420 | 10.03 | 4.54 | 2.49 | 6.94 | 10.04 | 4.52 | 2.46 | 6.88 |
| 58 | | 2.5 | 6 | 420 | 10.03 | 4.59 | 2.52 | 6.95 | 10.03 | 4.57 | 2.49 | 6.90 |

Comparative Example 3

Synthesized barium stearate (Ba content 12.0% by weight) was pulverized minutely and passed through a sieve in order to obtain fine powder of 250 mesh or less. This barium stearate (St.Ba) was used, and, as with Example 1, graphite powder 1.0 wt % and the foregoing barium stearate (abbreviated as "St.Ba" in Table 8) 0.8 wt % (not included in the total number) were mixed with iron powder 99 wt %.

This mixed powder (fill of 1.5 to 2.5 g) was molded into a specimen of approximately 10.02 to 10.04 mm ϕ×2.78 to 4.61 mmH at a molding pressure of 6 t/cm$^2$.

In order to judge the moldability, details regarding the relationship of the green density (GD) and molding pressure of each compact are shown in Table 8 (samples No. 61 to 68).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 8.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 8

| | | | | | Before Sintering | | | | After Sintering at 1150° C., 1 hr, under H$^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 61 | St.Ba | 1.5 | 6 | 420 | 10.03 | 2.78 | 1.51 | 6.88 | 10.03 | 2.79 | 1.49 | 6.76 |
| 62 | | 1.5 | 6 | 420 | 10.04 | 2.81 | 1.51 | 6.79 | 10.03 | 2.82 | 1.50 | 6.74 |
| 63 | | 2.5 | 6 | 420 | 10.03 | 4.61 | 2.51 | 6.89 | 10.03 | 4.62 | 2.48 | 6.80 |
| 64 | | 2.5 | 6 | 420 | 10.03 | 4.61 | 2.51 | 6.89 | 10.04 | 4.62 | 2.48 | 6.78 |
| 65 | | 2.5 | 6 | 420 | 10.03 | 4.59 | 2.50 | 6.90 | 10.04 | 4.59 | 2.48 | 6.83 |
| 66 | | 2.5 | 6 | 420 | 10.03 | 4.57 | 2.50 | 6.93 | 10.03 | 4.58 | 2.47 | 6.83 |
| 67 | | 2.5 | 6 | 420 | 10.02 | 4.56 | 2.49 | 6.93 | 10.03 | 4.56 | 2.46 | 6.83 |
| 68 | | 2.5 | 6 | 420 | 10.03 | 4.56 | 2.48 | 6.89 | 10.03 | 4.57 | 2.46 | 6.82 |

Comparative Example 4

Synthesized stearic acid (rare earth) (Ce 6.2 wt %, La 3.4 wt %, Nd 1.8 wt %, Pr 0.6 wt %) was pulverized minutely and passed through a sieve in order to obtain fine powder of 250 mesh or less.

Stearic acid (rare earth such as Ce, La, Nd, Pr) was used, and as with Example 1, graphite powder 1.0 wt % and the foregoing stearic acid (Ce, La, Nd, Pr) (abbreviated as "St.Re" in Table 9) 0.8 wt % (not included in the total number) were mixed with iron powder 99 wt %.

This mixed powder (fill of 1.5 to 2.5 g) was molded into a specimen of approximately 10.03 mm ϕ×2.74 to 4.56 mmH at a molding pressure of 6 t/cm$^2$.

In order to judge the moldability, details regarding the relationship of the green density (GD) and molding pressure of each compact are shown in Table 9 (samples No. 71 to 78).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 9.

As with Example 1, this sintered body was set inside a temperature and humidity controlled bath, and subject to a humidity oxidation test by performing an atmospheric exposure test in an atmosphere at a temperature of 40° C. and humidity of 90% for 336 hours. The humidity oxidation test results are shown in Table 2.

TABLE 9

| | | | | | Before Sintering | | | | After Sintering at 1150° C., 1 hr, under H$^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 71 | St.Re | 1.5 | 6 | 420 | 10.03 | 2.76 | 1.52 | 6.97 | 10.03 | 2.76 | 1.51 | 6.93 |
| 72 | | 1.5 | 6 | 420 | 10.03 | 2.74 | 1.51 | 6.98 | 10.03 | 2.75 | 1.49 | 6.86 |
| 73 | | 2.5 | 6 | 420 | 10.03 | 4.56 | 2.52 | 7.00 | 10.03 | 4.55 | 2.48 | 6.90 |
| 74 | | 2.5 | 6 | 420 | 10.03 | 4.54 | 2.51 | 7.00 | 10.03 | 4.54 | 2.48 | 6.92 |
| 75 | | 2.5 | 6 | 420 | 10.03 | 4.53 | 2.50 | 6.99 | 10.03 | 4.53 | 2.47 | 6.90 |
| 76 | | 2.5 | 6 | 420 | 10.03 | 4.55 | 2.51 | 6.99 | 10.03 | 4.52 | 2.47 | 6.92 |
| 77 | | 2.5 | 6 | 420 | 10.03 | 4.54 | 2.50 | 6.97 | 10.03 | 4.51 | 2.47 | 6.94 |
| 78 | | 2.5 | 6 | 420 | 10.03 | 4.52 | 2.49 | 6.98 | 10.03 | 4.47 | 2.45 | 6.94 |

Comparative Example 5

Further, additive free iron powder (Hoganas reduced iron powder (fill of 1.5 to 2.5 g)) was molded into a specimen of approximately 10.02 to 10.04 mm ϕ×2.75 to 4.60 mmH at a molding pressure 6 t/cm$^2$. Similarly, in order to the moldability, details regarding the relationship of the green density (GD) and molding pressure of each compact are shown in Table 10 (samples No. 81 to 88).

Moreover, the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 10.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 10

| | | | | | Before Sintering | | | | After Sintering at 1150° C., 1 hr, under H$^2$ | | | |
|---|---|---|---|---|---|---|---|---|---|---|---|---|
| No. | Soap | Fill g | Pressure t · cm$^{-2}$ | Pressure (Device) kgf · cm$^{-2}$ | ϕ mm | t mm | w g | GD g/cc | ϕ mm | t mm | w g | SD g/cc |
| 81 | Additive | 1.5 | 6 | 420 | 10.02 | 2.75 | 1.51 | 6.97 | 10.05 | 2.76 | 1.49 | 6.81 |
| 82 | Free | 1.5 | 6 | 420 | 10.02 | 2.77 | 1.50 | 6.87 | 10.04 | 2.76 | 1.52 | 6.96 |
| 83 | | 2.5 | 6 | 420 | 10.02 | 4.60 | 2.53 | 6.98 | 10.04 | 4.60 | 2.51 | 6.90 |
| 84 | | 2.5 | 6 | 420 | 10.04 | 4.58 | 2.54 | 7.01 | 10.04 | 4.58 | 2.52 | 6.95 |
| 85 | | 2.5 | 6 | 420 | 10.02 | 4.56 | 2.51 | 6.98 | 10.04 | 4.56 | 2.49 | 6.90 |
| 86 | | 2.5 | 6 | 420 | 10.03 | 4.55 | 2.51 | 6.99 | 10.04 | 4.54 | 2.50 | 6.96 |
| 87 | | 2.5 | 6 | 420 | 10.03 | 4.54 | 2.50 | 6.97 | 10.04 | 4.54 | 2.48 | 6.90 |
| 88 | | 2.5 | 6 | 420 | 10.03 | 4.51 | 2.49 | 6.99 | 10.04 | 4.51 | 2.47 | 6.92 |

As evident from Table 1 to Table 10, roughly the same green density is obtained from the evaluation results of compressibility. Further, the extraction pressure (kg) after molding is shown in Table 11, and the compact added with the metallic soap of the present invention has low extraction pressure in comparison to those without any additive, and roughly the same extraction pressure is obtained as in the case of adding zinc stearate.

As described above, it is evident that Example 1 to Example 4 added with the metallic soap of the present invention have roughly the same lubricating ability and moldability as Comparative Example 1 added with the zinc stearate lubricant.

TABLE 11

| | | Extraction pressure (kg) | | |
|---|---|---|---|---|
| | Kinds of Soap | 5 t/cm$^2$ | 6 t/cm$^2$ | 7 t/cm$^2$ |
| Example 1 | St. Co + St. In<br>St. Co + St. Sn | 393 | 454 | 463 |
| Example 2 | Npht.Mo + St.Sn | 350 | 370 | 400 |
| Example 3 | St. Ni + St. Bi<br>St. Ni + St. In<br>St. Ni + St. Sn | | | |
| Example 4 | St. Pd + St. Bi<br>St. Pd + St. In<br>St. Pd + St. Sn | | | |
| Comparative Example 1 | St. Zn | 306 | 387 | 398 |
| Comparative Example 2 | St. Sr | 338 | 362 | 378 |
| Comparative Example 3 | St. Ba | 280 | 348 | 354 |

TABLE 11-continued

| | | Extraction pressure (kg) | | |
|---|---|---|---|---|
| | Kinds of Soap | 5 t/cm$^2$ | 6 t/cm$^2$ | 7 t/cm$^2$ |
| Comparative Example 4 | St. Re | 298 | 374 | 380 |
| Comparative Example 5 | Additive Free | 464 | 890 | 958 |

Npht.: Naphthenate

Next, as clear from Table 2, with Example 5 where a lubricant is not added to the iron powder, in the humidity oxidation resistance test after sintering, discoloration (corrosion) occurred 96 hours (4 days) later, and the degree of discoloration increased gradually pursuant to the lapse of time, and resulted in severe discoloration after the lapse of 336 hours.

Meanwhile, the strontium stearate of Comparative Example 2 showed even more discoloration than the additive free Comparative Example 5, and resulted in sever discoloration pursuant to the lapse of time. Further, the stearic acid (Ce, La, Nd, Pr) (rare earth) of Comparative Example 4 showed severe discoloration even after 96 hours (4 days). As described above, it is evident that the strontium stearate of Comparative Example 2 and the stearic acid (Ce, La, Nd, Pr) (rare earth) of Comparative Example 4 have a lower rust prevention effect than cases without any additives.

Meanwhile, the addition of zinc stearate in Comparative Example 1 and the addition of barium stearate in Comparative Example 3 were roughly the same as the additive free Comparative Example 5 even after the lapse of 336 hours, and it is clear that the addition of zinc stearate and barium stearate have no effect in the humidity oxidation resistance.

Contrarily, Example 1 to Example 4 added with the metallic soap of the present invention merely show slight discoloration in the foregoing humidity oxidation resistance test even after the lapse of 336 hours, and it is evident that they possess humidity oxidation resistance.

Incidentally, although not specifically described, examples for the combinations other than those described above and the cases of compound additions thereof showed similar results as Example 1 to Example 4.

Accordingly, it has been confirmed that the mixed powder for powder metallurgy obtained by adding the metallic soap of the present invention to the iron-based metal powder for powder metallurgy has favorable moldability, and is also superior in moisture resistance and oxidation resistance.

As described above, as a result of obtaining mixed powder for powder metallurgy by adding the metallic soap of the present invention to iron-based metal powder for powder metallurgy, the rust prevention effect of sintered bodies can be exponentially improved without changing the conventional sintered body manufacturing process, and this is extremely effective for various sintered bodies such as sintered machine parts, sintered oil retaining bearings and metal graphite brushes.

The invention claimed is:

1. Iron-based metal powder for powder metallurgy, comprising an iron-based metal powder including a metallic soap containing at least one or more types of metal selected from the group consisting of Ag, Au, Bi, Co, Cu, Mo, Ni, Pd, Pt, Sn and Te having a higher standard oxidation potential than iron, and an additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P which forms a liquid phase at a temperature of 1200° C. or less in the combination with said metal, and being a soap containing metals for forming an alloy phase between the metals.

2. An iron-based sintered body having a rust prevention function, prepared by a process comprising the steps of forming an iron-based sintered body from an iron-based metal powder including a metallic soap containing at least one or more types of metal selected from the group consisting of Ag, Au, Bi, CO Cu, Mo, Ni, Pd, Pt, Sn and Te having a higher standard oxidation potential than iron, and an additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P which forms a liquid phase at a temperature of 1200° C. or less in the combination with said metal, and forming an alloy phase constituted from both metals on the sintered body surface upon sintering.

3. A method of making an iron-based sintered body having a rust prevention function, comprising the steps of forming an iron-based sintered body from an iron-based metal powder including a metallic soap containing at least one or more types of metal selected from the group consisting of Ag, Au, Bi, Co Cu, Mo, Ni, Pd, Pt, Sn and Te having a higher standard oxidation potential than iron, ad a additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P which forms a liquid phase at a temperature of 1200° C. or less in the combination with said metal, and forming an alloy phase constituted from both metals on a surface of the sintered body upon sintering.

4. A method according to claim 3, wherein said alloy phase is formed between: (i) said at least one or more types of metal selected from the group consisting of Ag, Au, Bi, Co, Cu, Mo, Ni, Pd, Pt, Sn and Te; and (ii) said additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P.

5. An iron-based sintered body according to claim 2, wherein said alloy phase is formed between: (i) said at least one or more types of metal selected from the group consisting of Ag, Au, Bi, Co, Cu, Mo, Ni, Pd, Pt, Sn and Te; and (ii) said additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P.

6. Iron-based metal powder according to claim 1, wherein said alloy phase being one formed of: (i) said at least one or more types of metal selected from the group consisting of Ag, Au, Bi, Co, Cu, Mo, Ni, Pd, Pt, Sn and Te; and (ii) said additional metal of one or more types of metal selected from the group consisting of Zn, Al, Sb, Yb, K, Ga, Ca, Au, Ag, Ge, Sm, Sn, Ce, Te, Cu, Na, Nb, Ba, Bi, Pr, Mg, Eu, La, Li, and P.

* * * * *

UNITED STATES PATENT AND TRADEMARK OFFICE

CERTIFICATE OF CORRECTION

PATENT NO. : 7,666,245 B2
APPLICATION NO. : 11/574294
DATED : February 23, 2010
INVENTOR(S) : Imori et al.

It is certified that error appears in the above-identified patent and that said Letters Patent is hereby corrected as shown below:

Column 9, line 20 "of 4° C. and" should read "of 40° C. and"

Column 16, line 5 "iron, ad a additional" should read "iron, and an additional"

Signed and Sealed this

Eighteenth Day of May, 2010

David J. Kappos

David J. Kappos
*Director of the United States Patent and Trademark Office*